US012448781B2

(12) United States Patent
Quist

(10) Patent No.: US 12,448,781 B2
(45) Date of Patent: Oct. 21, 2025

(54) MULTI THICKNESS CLIPS

(71) Applicant: Välinge Innovation AB, Viken (SE)

(72) Inventor: Karl Quist, Höganäs (SE)

(73) Assignee: VÄLINGE INNOVATION AB, Viken (SE)

( * ) Notice: Subject to any disclaimer, the term of this patent is extended or adjusted under 35 U.S.C. 154(b) by 261 days.

(21) Appl. No.: 18/202,978

(22) Filed: May 29, 2023

(65) Prior Publication Data

US 2023/0383542 A1 Nov. 30, 2023

(30) Foreign Application Priority Data

May 30, 2022 (SE) ..... 2250645-5

(51) Int. Cl.
*E04F 13/08* (2006.01)

(52) U.S. Cl.
CPC ..... *E04F 13/0826* (2013.01); *E04F 13/0894* (2013.01); *E04F 2201/0153* (2013.01); *E04F 2201/023* (2013.01)

(58) Field of Classification Search
CPC ..... E04F 15/02033; E04F 15/02038; E04F 15/107; E04F 15/102; E04F 2201/042; E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138; E04F 13/0826; E04F 13/0894
See application file for complete search history.

(56) References Cited

U.S. PATENT DOCUMENTS 7,010,894 B1 3/2006 Cappelle
9,458,634 B2 * 10/2016 Derelov ..... E04F 15/02038
9,850,667 B2 * 12/2017 Engstrom ..... E04F 15/02044
(Continued)

FOREIGN PATENT DOCUMENTS

DE 20200268 U1 3/2002
WO 2011/006813 A2 1/2011
(Continued)

OTHER PUBLICATIONS

Office Action issued by Swedish Patent and Registration Office (PRV) on Jan. 5, 2023 in Swedish Patent Application No. 2250645-5 (8 pages).
(Continued)

*Primary Examiner* — Chi Q Nguyen
(74) *Attorney, Agent, or Firm* — Boone IP Law

(57) ABSTRACT

A set containing a first building element, a first building panel a second building panel and a coupling element for assembling the first building panel and the second building panel to the first building element. The coupling element has a locking portion configured to cooperate with a first mechanical locking device of a first edge or of a second edge of the first building element. The coupling element also has a connecting portion configured to cooperate with a second mechanical locking device of an edge of a building panel. The second mechanical locking device is configured for locking the first and second building panels and including a locking tongue and a tongue groove having a locking strip with an upper surface.

20 Claims, 12 Drawing Sheets

(56) References Cited

U.S. PATENT DOCUMENTS

| | | | | |
|---|---|---|---|---|
| 11,326,355 | B2 * | 5/2022 | Bergelin | E04F 15/102 |
| 11,371,247 | B2 * | 6/2022 | Fahle | E04F 13/0826 |
| 11,629,505 | B2 * | 4/2023 | Braun | E04B 1/388 52/506.05 |
| 11,946,260 | B2 * | 4/2024 | Ylikangas | E04F 13/0826 |
| 12,031,319 | B2 * | 7/2024 | Ylikangas | E04F 13/0826 |
| 2003/0009973 | A1 * | 1/2003 | Lee | E04F 15/04 52/489.1 |
| 2005/0204677 | A1 * | 9/2005 | Mei | E04F 15/04 52/582.1 |
| 2022/0170275 | A1 * | 6/2022 | Ylikangas | E04F 13/0894 |
| 2024/0191516 | A1 * | 6/2024 | Ylikangas | B27M 3/0066 |
| 2024/0229452 | A1 * | 7/2024 | Quist | E04B 1/6116 |
| 2025/0084649 | A1 * | 3/2025 | Claerhout | E04F 13/0894 |

FOREIGN PATENT DOCUMENTS

| | | | |
|---|---|---|---|
| WO | 2012/020093 | A2 | 2/2012 |
| WO | 2020/197457 | A1 | 10/2020 |

OTHER PUBLICATIONS

International Search Report and Written Opinion received for PCT Patent Application No. PCT/SE2023/050521, mailed on Jun. 12, 2023, 11 pages.
U.S. Appl. No. 16/713,293, Roger Ylikangas, filed Dec. 13, 2019.
U.S. Appl. No. 17/456,406, Roger Ylikangas, filed Nov. 24, 2021.

* cited by examiner

MULTI THICKNESS CLIPS

CROSS REFERENCE TO RELATED APPLICATIONS

The present application claims the benefit of Swedish Application No. 2250645-5, filed on May 30, 2022. The entire contents of Swedish Application No. 2250645-5 are hereby incorporated herein by reference in their entirety.

TECHNICAL FIELD

The disclosure relates to a set comprising a coupling element, a building element and at least two building panels.

BACKGROUND

Known systems for assembling building panels typically comprise various types fastening rails mounted to a fixed structure, such as a wall. Wall panels to be assembled are typically arranged to extend transverse the rails. A mounting device is fixedly attached to the rail or to the wall panel and provides a link between the rails and the wall panel.

WO2020/197457 discloses a set comprising a coupling element, a first building element, a first building panel and a second building panel, wherein the coupling element is configured for assembling the first building panel and the second building panel to the first building element.

Known systems are however associated with shortcomings in terms of flexibility of the system and/or compatibility of the system with different panels. As such, there is room for improvements in the technical field.

SUMMARY

One object of the disclosure is to alleviate, at least in part, at least some of the drawbacks of the prior art. One object of the disclosure is to provide a set for assembling building panels and building element using coupling elements, where the coupling element may be used with building panels of different thicknesses. One object of the disclosure is to provide a set comprising building panels, a coupling element, and a building element with a more versatile coupling element.

According to one aspect of the disclosure, there is provided a set comprising a coupling element, a first building element, a first building panel and a second building panel. The coupling element is configured for assembling the first building panel and the second building panel to the first building element. The coupling element comprises at least one locking portion protruding along a primary axis. The locking portion may extend along the secondary axis. The locking portion is configured to cooperate with a first mechanical locking device of a first edge or of a second edge of the first building element, each extending along the secondary axis, to obtain an assembled state therewith by means of a folding displacement of the coupling element about the secondary axis to thereby lock the coupling element from displacement along a primary axis and a perpendicular tertiary axis each being orthogonal to the secondary axis. The coupling element comprises a connecting portion protruding in a direction along the tertiary axis and configured to cooperate with a second mechanical locking device of a first edge of a first building panel and an opposite second edge of the second building panel. The connecting portion extends in a direction along the primary axis. The second mechanical locking device is configured for locking the first and second panels in a direction of the tertiary axis, which is transverse a plane of a front surface of the first and the second building panel by means of a folding displacement of the second panel about its second edge. The second mechanical locking device comprises a locking tongue and a tongue groove. The tongue groove has a locking strip with an upper surface. The connecting portion comprises a first portion protruding along the tertiary axis and a contiguous second portion protruding along the secondary axis in assembled state. The second portion is configured to engage with a connecting surface of the first building panel. The connecting surface of said first building panel is closer to a back surface of said first building panel than the point of the upper surface of the locking strip that is closest to the back surface. Thus, the placing of the connecting surface of the first building panel is not limited or closely related to the thickness of the locking strip of the first building panel. Further, the connecting surface may be independent of the thickness of the panel, allowing for using the same size coupling element with building panels of different thickness.

The locking strip may be located on the side of the tongue groove closer to the back surface.

The second mechanical locking device may comprise a locking groove and the locking strip may comprise a locking element. The locking groove may be configured to cooperate with the locking element for a locking in a direction of the secondary axis.

The locking strip may comprise the connecting surface or the locking groove may comprise the connecting surface. The connecting surface may thus be part of a shelf, a recess, or a groove, such as a shelf or a groove. The locking strip may comprise a shelf which comprises the connecting surface. The locking groove may comprise a groove which comprises the connecting surface. The connecting surface may be a shelf or a groove, such as a groove. The connecting surface may be a shelf. The connecting surface may be planar. The connecting surface may be planar and parallel with the primary axis and/or the secondary axis, preferably parallel with the plane of the primary axis and the secondary axis. The connecting surface may extend along the plane of the primary axis the secondary axis.

The first portion of the connecting portion may protrude into the locking groove, of the first or the second building panel, in the assembled state. The first portion of the connecting portion may protrude into the locking groove, of the second building panel, in the assembled state.

The coupling element may further comprise a protruding member configured to cooperate with the first panel. The protruding member may be configured to facilitate relative positioning between the coupling element and the first panel. In particular, the protruding member may be configured to facilitate relative positioning between the connecting portion and the first edge of the first panel. The relative positioning may be achieved by displacing and/or biasing a portion of the first edge and a portion of the connecting portion, such as the first portion and/or the second portion, towards each other. Thereby, it is facilitated that the coupling element may be positioned in a desired position where it may not constitute a mechanical obstacle when a second panel is assembled with the first panel.

A further advantage of providing a protruding member according to embodiments herein may be that the coupling element may be prevented from dislodging during assembling of for example a second building panel.

A still further advantage of providing protruding member according to embodiments herein may be that the coupling element may be prevented from displacing along the secondary axis.

Another advantage of providing protruding member according to embodiments herein is that the coupling element may thereby be configured to accommodate slightly different thicknesses of the first panel. For example, the distance between a surface of the (contiguous) second portion of the connecting portion and the back surface of the first panel may not correspond to the distance between the second portion and the primary plane and/or the body of the coupling element. For example, there may be play P between the back surface and the primary plane (V1) and thus the coupling element and the first panel may in the absence of the protruding member displace relative each other to obtain an undesired relative position.

The protruding member may be provided on a same side of the coupling element as the connecting portion.

The protruding member may extend from the coupling element body in a direction towards or away from the connecting portion.

At least a portion of the protruding member may be displaceable, for example by means of being flexible.

The protruding member may be provided adjacent the connecting portion.

The protruding member may be provided between two locking portions.

The protruding member may be configured to be provided below the connecting portion along the primary axis, when the building element is in the assembled state with the first building panel, by means of the coupling element.

At least at part of the protruding member may be elastic.

The protruding member may be configured to, in the assembled state of the coupling element and the first building element, protrude from a primary plane of the front surface of the coupling element.

The protruding member may be configured to cooperate with a back surface of the first panel.

The protruding member may be configured for relative positioning of at least a portion of the coupling element, such as the connecting portion, and at least a portion of the first panel, such as the first edge.

The protruding member may be configured to, in the assembled state of the coupling element with the first panel, bias against the back surface of the first building panel.

The protruding member may be configured to, in assembled state of the coupling element with the first panel, bias the connecting portion in a direction along the tertiary axis towards the first building panel, such as in a distal direction.

The protruding member may be configured to bridge a play between a primary plane of a front surface of the coupling element and a back surface of the first panel.

The protruding member is configured to, in the assembled state of the coupling element with the first panel, cooperate with a groove provided in the back surface of the first panel to thereby lock or prevent the connecting portion and the first edge of the first panel from parting away from each other in a direction along the secondary axis.

The protruding member comprises at least one portion that is displaceable relative the secondary connecting means, such as in a direction along the tertiary axis.

The protruding member comprises an attached portion and at least one free portion, preferably said at least one free portion is an end portion.

The protruding member comprises at least one portion protruding along the secondary axis in a direction towards or away from the connecting portion, and from an attached portion to a free portion.

At least one portion of said protruding member, preferably the free portion, comprises means configured to facilitate friction, such as friction between said at least one portion and an adjacent surface, such as the back surface of the first panel. The means configured to facilitate friction may be a that the free portion is pointy, rugged, divided into several smaller points of contact or made out of rubber.

The tongue groove may be at a first edge of the first building panel and the locking tongue of the second mechanical locking device may be at the opposite second edge of the second building panel.

According to one embodiment, the locking portion extends along a secondary axis.

According to one embodiment, the connecting portion extends in a direction along the primary axis.

The connecting portion may be shaped like a hook.

BRIEF DESCRIPTION OF THE DRAWINGS

Embodiments of the present inventive concept will by way of example be described in more detail with reference to the appended schematic drawings, which show several embodiments of the inventive concept.

DETAILED DESCRIPTION

Figure 1:
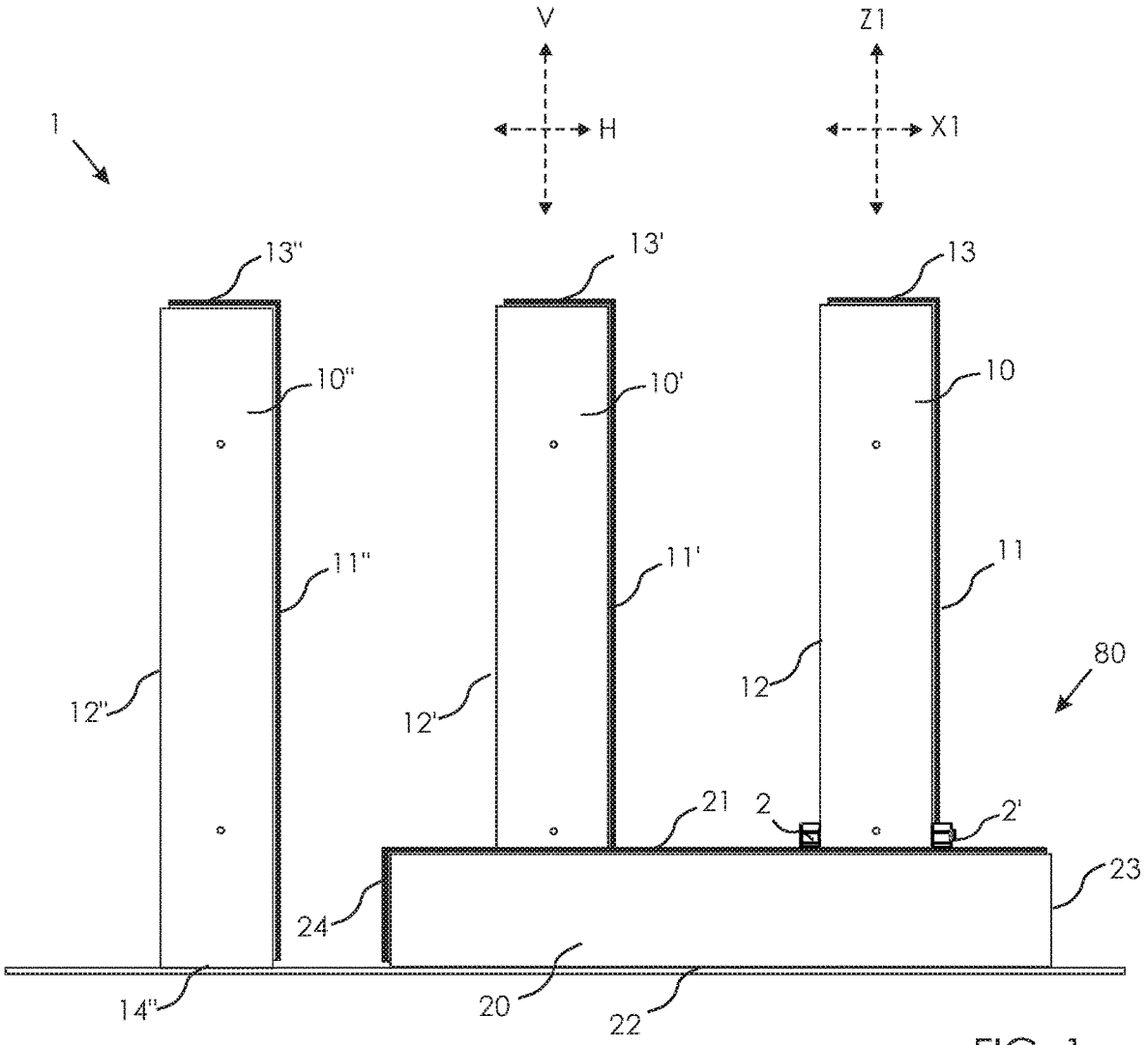
FIG. 1 is a schematic view of a set according to embodiments of the inventive concept.
Figure 2:
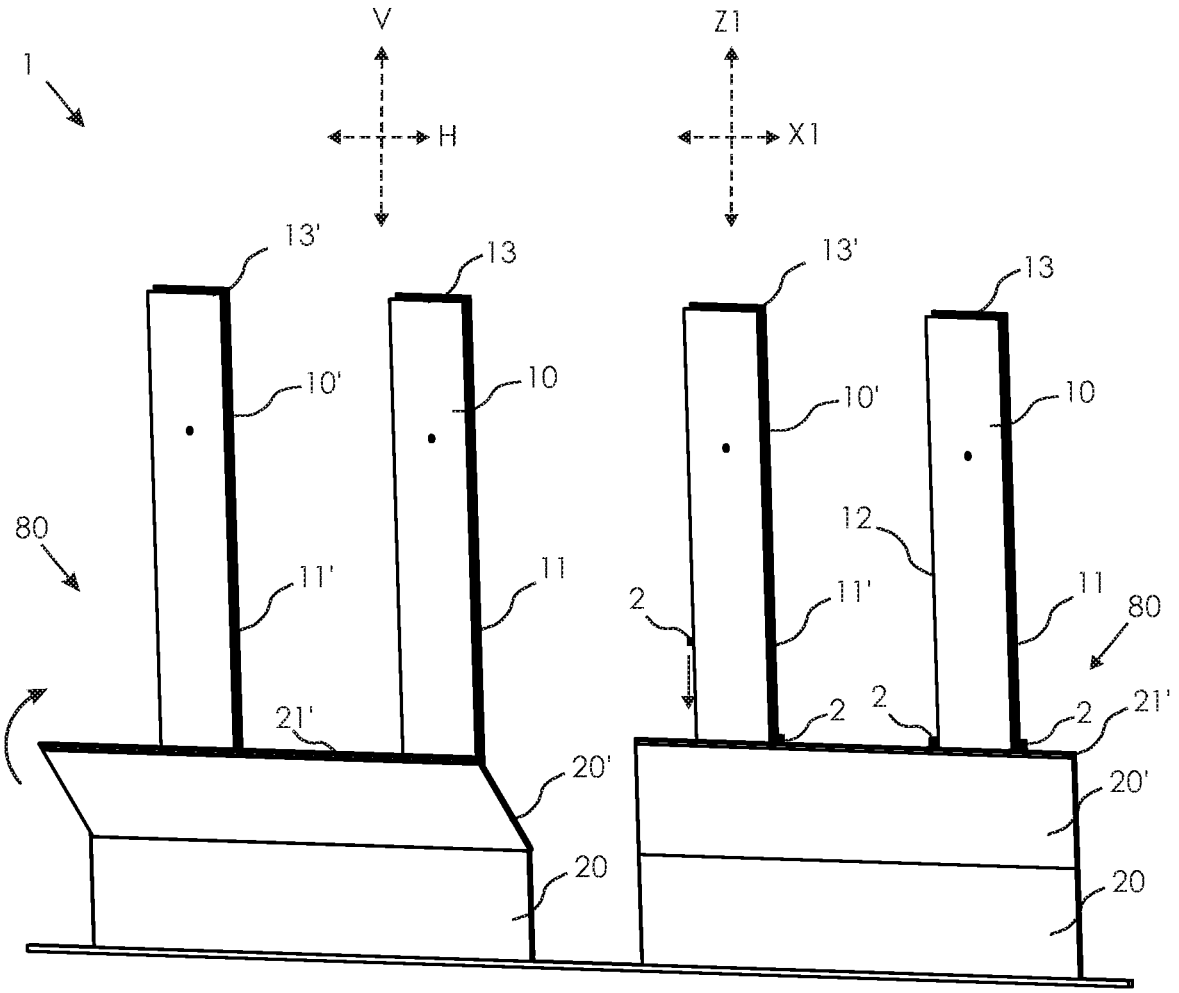
FIG. 2 is a perspective view of a set according to an embodiment.
Figure 3A:
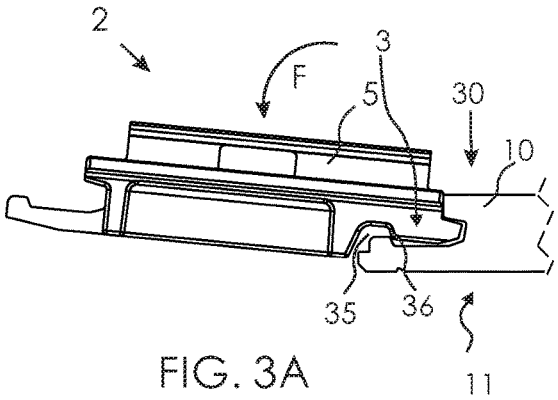
FIGS. 3A-3D are top view of details of the coupling element and the building element of the embodiment of FIG. 1.
Figure 3B:
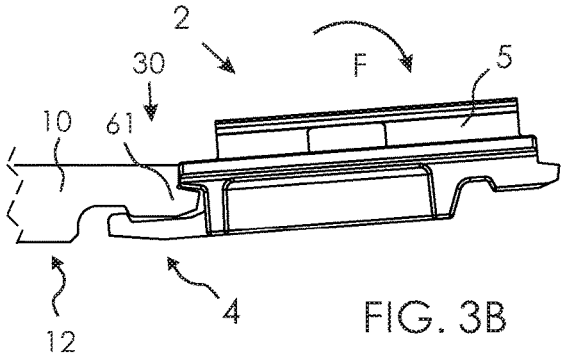
Figure 3C:
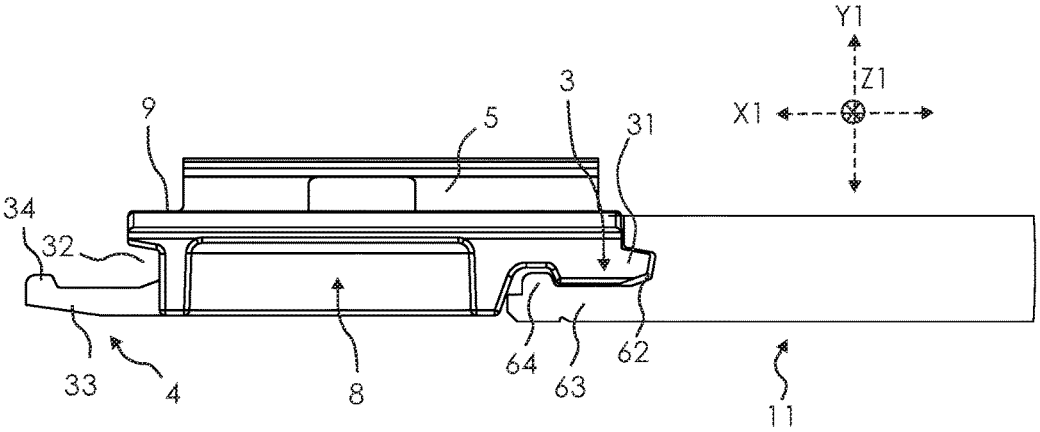
Figure 3D:
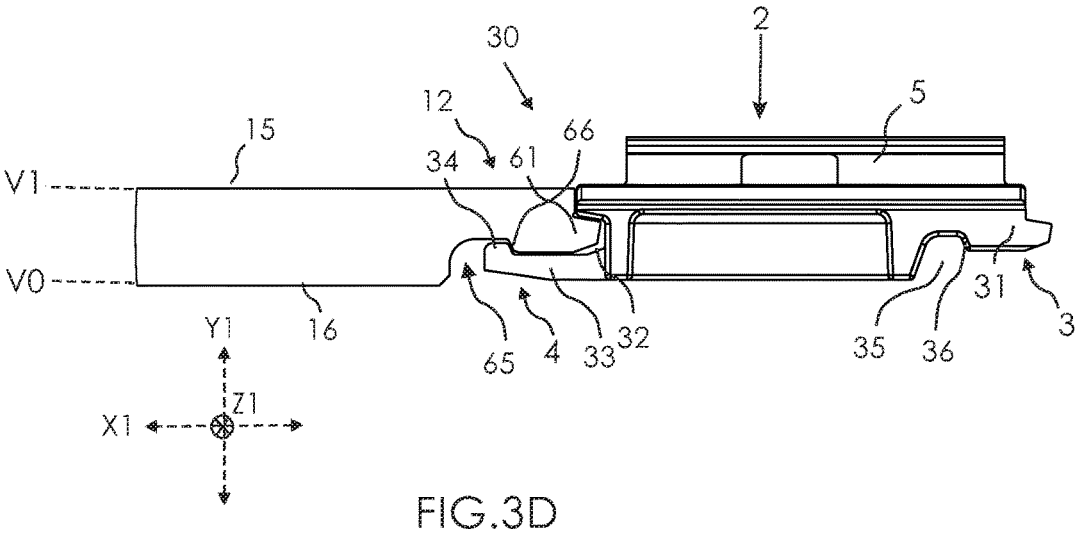

FIGS. 1, 2 show embodiments of a set 1 comprising one or more coupling elements 2, 2', one or more building elements 10, 10' 10", which may be provided in the shape of building panels, one or more building panels 20, 20' which may be wall panels.

The first building element 10 may have four edges 11, 12, 13, 14. The first building panel 20 may have four edges 21, 22, 23, 24.

The first building element 10 may, at least along a portion of an edge, comprise a first mechanical locking device 30 for horizontal and vertical locking of adjacent building elements comprising the first mechanical locking device 30, as shown in FIGS. 3A-3D. The building panels 20, 20' may at least along a portion of an edge comprise a second mechanical locking device 50 for horizontal (Y1) and vertical locking (Z1) of adjacent building panels comprising the second mechanical locking device 50, as shown in 4A-4B.

The first mechanical locking device 30 and the second mechanical locking device 50 may be configured to cooperate such that a first building element 10 comprising the first mechanical locking device 30 can be configured in an assembled state with a second building element 20' comprising the second mechanical locking device 50, to thereby lock first and second elements 10, 20 in a horizontal and a vertical direction.

Thus, the first building element 10 and the first building panel 20 may according to embodiments comprise the same mechanical locking device.

The first building element 10 and the first building panel 20 may according to embodiments comprise essentially identical or similar panels.

The set, according to an embodiment enables that a coupling element 2 may be used for panels of different thicknesses. One size of coupling element may be suitably used for building panels with a thickness of 5-7 mm, which building panels may be of polymer-based material and another size for building panels with a thickness of 7-14 mm, such as 8-14 mm, which are typically wood-based materials. Polymer-based building panels may be based on thermoplastic, such as polyvinyl chloride.

The coupling element 2 may be made of any suitable material such as metal, composite, or a polymer-based material, such as plastic, such as selected from polyacrylate, polyamide, polyoxymethylene (POM), polypropylene, vinyl or PVC. The coupling element may be of a thermosetting material or thermoplastic material.

In FIGS. 1 and 2, the set 1 is arranged on a wall 80 with the building panels 20, 20' arranged with their respective longitudinal axis extending horizontally H, however other configurations are possible within the scope of the disclosure.

Referring to FIGS. 1 and 2, the first edge 21 of the first panel 20 may constitute an upper edge of the first panel 20 in assembled state of the first panel 20, as illustrated in FIG. 1.

The second edge 22 of the first panel 20 may constitute a lower edge of the first panel 20 in assembled state of the first panel 20.

The first edge 11 of the first building element 10 may constitute a right-hand edge of the first building element 10 in assembled state of the first building element 10 as illustrated e.g., in FIGS. 1 and 2. However, other configurations are possible within the scope of the disclosure, such as a left-hand edge.

The second edge 12 of the first building element 10 may constitute a left-hand edge of the first building element 10 in assembled state of the first building element 10 as illustrated in FIGS. 1 and 2. However, other configurations are possible within the scope of the disclosure, such as a right-hand edge.

As used herein, the term "edge" refers to an outer edge extending in the thickness direction D of the building element or building panel, such as the first building element 10 or the first building panel 20, between the front surface 15, 25 and the back surface 16, 26 of the building element or the building panel. Thus, the edges may face in a direction along the primary axis X1 and/or along the front surface 15 away from the building element 10, as shown in FIGS. 3A-3D.

The first building element 10 may be a joist or like, having an outer edge facing in a direction along the front surface 15 and comprising a first mechanical locking device 30 for horizontal and vertical locking with other building elements comprising the same locking system 30, preferably by means of folding.

Building elements may be building panels.

Building panels, first panels 20, 20' may have a respective front surface 25 and back surface 26. The front surface 25 may be a proximal and/or front surface. The front surface may be a surface intended to be visible when the panel is configured as part of a wall or floor. The front surface may be a decorative surface and may comprise a decorative layer, such as a veneer layer intended to be visible.

The back surface 26 may be a surface which is not intended to be visible when the panel is configured as part of a wall or a floor. The back surface may comprise a balancing layer to account for movements in the front surface 25.

The building panels 20, 20', and optionally the building elements 10, 10', may comprise a core made of or comprising any suitable material, such as wood, MDF, HDF, foam, polymers, thermoplastic, thermosetting, PVC, MgO, or any suitable material. Preferably, the core is made of a material suitable for machining, such as cutting, for example by means of rotating tools. The first and/or second mechanical locking device 30, may be formed in the core of the building element, for example by means of cutting with rotating tools which are substantially stationary while the building elements are conveyed past the rotating tool to thereby form at least part of the mechanical locking device in one or more of the edges 11, 12 of the building elements and of the edges 21, 22 of the building panels.

The coupling element 2 may, when assembled with an edge of a building element, be slid along the edge of the building element.

With reference to FIGS. 3A-4B, the set, according to an embodiment comprises a coupling element 2, a first building element 10, a first building panel 20 and a second building panel 20'. The coupling element 2 is configured for assembling the first building panel 20 and the second building panel 20' to the first building element 10. The coupling element may have a body 8 and a front surface 9. The front surface may extend in the X1-Z1 plane and face in a direction along the tertiary axis Y1. The coupling element 2 has at least one locking portion 3, 4 protruding along a primary axis X1. The locking portion 3, 4 is configured to cooperate with a first mechanical locking device 30 of a first edge 11 or of a second edge 12 of the first building element 10. The first and the second edge of the building element extend along the secondary axis Z1. The cooperation between at least one locking portion 3, 4 and the first edge 11 or the second edge 12 of the first building element 10 may give an assembled state by means of a folding displacement of the coupling element 2 about the secondary axis Z1 to thereby lock the coupling element 2 from displacement along a primary axis X1 and a perpendicular tertiary axis Y1 each being orthogonal to the secondary axis Z1. The building elements 10, 10' are typically attached vertically on a wall 80 and the coupling element 2 may be connected to the building element 10, 10' by the folding displacement F.

The first mechanical locking device 30 may be of a tongue and groove type configuration. A lock and groove type configuration means a locking device locking two edges to each other, where one side has a locking tongue and the other has a tongue groove. The locking tongue and the tongue groove may be configured to cooperate with each other. The side having a tongue groove may further have a locking strip, which may have a locking element. The locking element may be configured to cooperate with a locking groove. If the locking device 30 is a tongue and groove type configuration, the at least one locking portion 3, 4 may comprise either a locking tongue 31 or a tongue groove 32.

If the locking portion 3, 4 (here 3) comprises a locking tongue 31 (see e.g., FIG. 3A or 3C) it may be configured to cooperate with a tongue groove 62 of the first edge 11 or of a second edge 12 of the building element 10. The first edge 11 or the second edge 12 of the building element may further have a locking strip 63. The locking strip 63 may comprise a locking element 64. The locking element 64 may protrude from the locking strip 63 in a direction along the tertiary axis Y1 in the assembled state. The locking element 64 may be configured to cooperate with, preferably to be in contact with, a locking surface 36 in the locking groove 35 comprised in the locking portion 3, 4. The locking surface 36 may by located in a recess 35*b* in the locking groove 35.

If the locking portion 3, 4 (here 4) has a tongue groove 32 (see e.g., FIG. 3B or 3D), it may be configured to cooperate with a locking tongue 61 of a first edge 11 or of a second edge 12 of the building element 10. The locking portion 3, 4 may further have a locking strip 33. The locking strip 33 may comprise a locking element 34. The locking element 34 may protrude from the locking strip 33 in a direction along the tertiary axis Y1. The locking element 34 may be configured to cooperate with, preferably to be in contact with, a locking surface 66 in the locking groove 65 comprised in the locking portion 3, 4. The locking surface 66 may by located in a recess 65*b* in the locking groove 65.

According to some embodiments, the coupling element 2 comprises a first locking portion 3 and a second locking portion 4. The first locking portion 3 and the second locking portion 4 may protrude on opposite sides of the coupling element along the primary axis X1. The purpose of this may be that one coupling element may be compatible with both the first edge 11 and the second edge 12 of the first building element, making only one type of coupling element necessary to assemble a set comprising a plurality of building elements and building panels.

The first locking portion 3 may have a locking tongue 31 and a locking groove 35, whereas the second locking portion 4 may have a tongue groove 32 and a locking strip 33 with a locking element 34. Thus, one coupling element may be configured to cooperate with either of the first edge 11 and the second edge 12 of the building element.

Figure 4A:
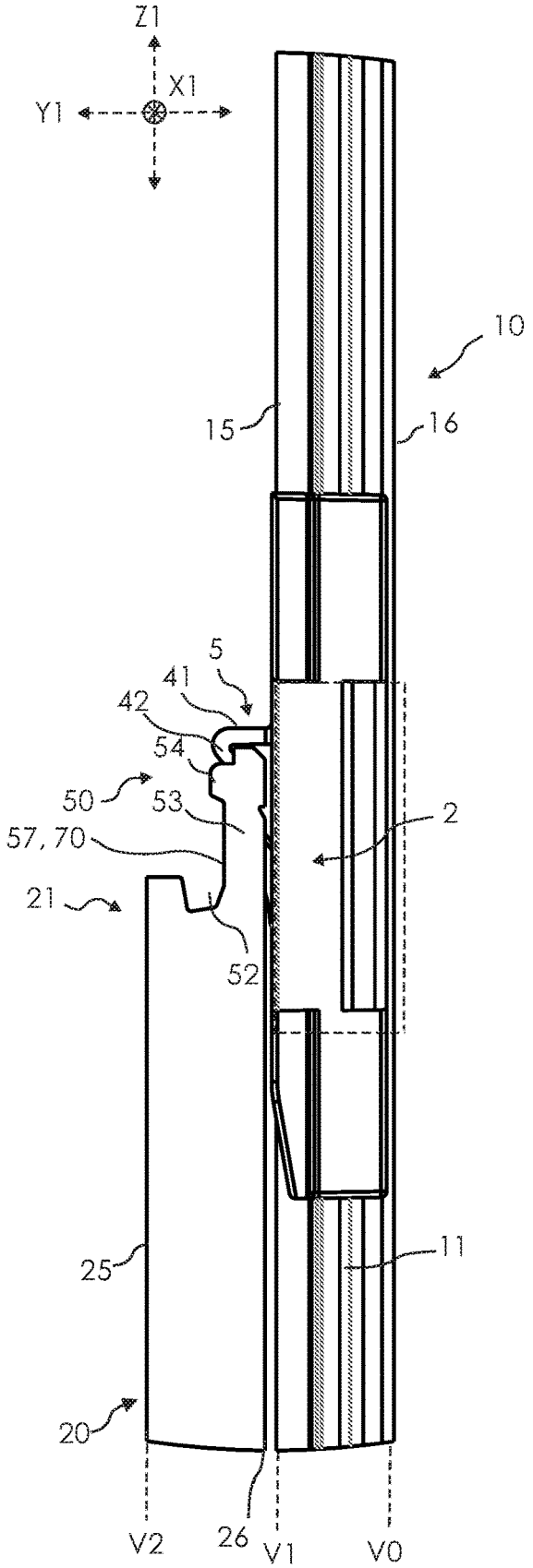
FIG. 4A is a side view of a first building panel arranged in assembled state with a first building element by means of a coupling element, according to an embodiment.
Figure 4B:
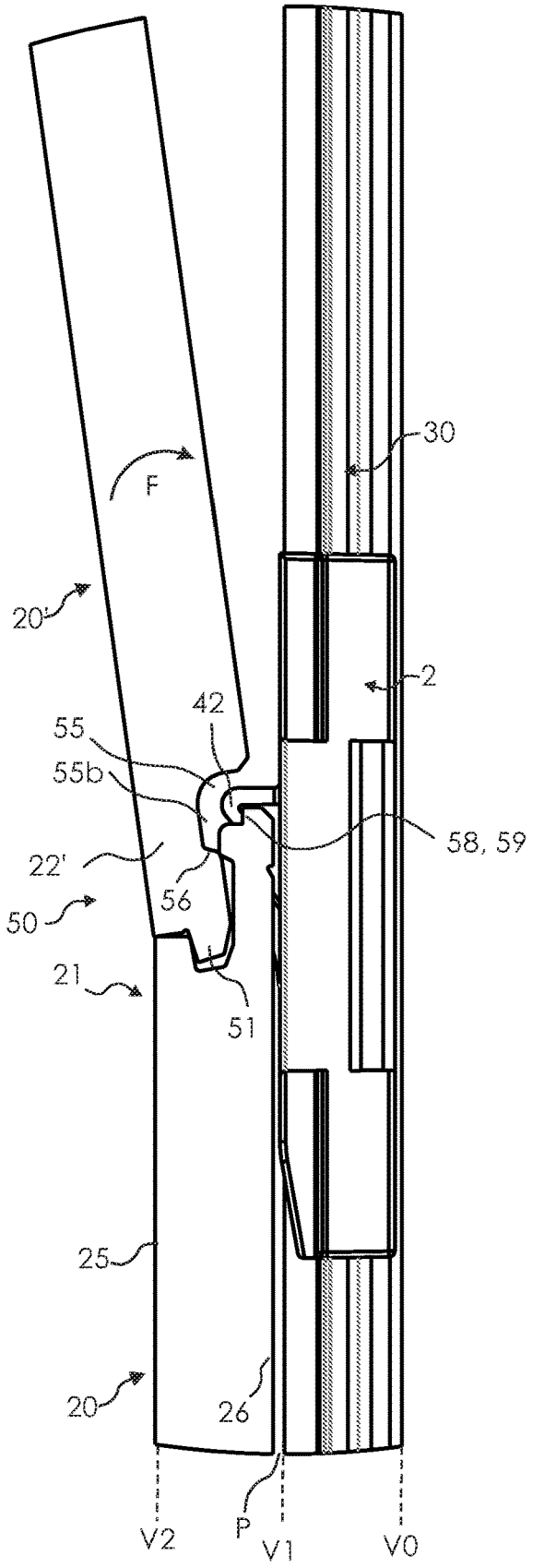
FIG. 4B is a side view of the embodiment of FIG. 4A with a second panel being assembled to the first panel by means of a folding displacement.

FIGS. 4A and 4B show a side view of how the coupling element 2 may cooperate with the second mechanical locking device 50 according to one embodiment. The figures show a coupling element 2 already assembled with a building element 10. The coupling element 2 comprises a connecting portion 5 protruding in a direction along the tertiary axis Y1. The coupling element is configured to cooperate with a second mechanical locking device 50 of a first edge 21 of a first building panel 20 and an opposite second edge 22 of the second building panel 20'. The second mechanical locking device 50 is configured for locking the first and second panels 20, 20' in a direction of the tertiary axis Y1, which is transverse a plane of a front surface 25, 25' by means of a folding displacement F of the second panel (20') about its second edge (22'). The second mechanical locking device 50 comprises a locking tongue 51 and a tongue groove 52, said tongue groove having a locking strip 53 with an upper surface 57. The connecting portion 5 of the coupling element 2 comprises a first portion 41 and a contiguous second portion 42. The first portion 41 protrudes along the tertiary axis Y1 and the contiguous second portion 42 protrudes along the secondary axis Z1 in the assembled state. The second portion 42 is configured to engage with a connecting surface 58 of said first building panel 20. The connecting surface 58 of said first building panel 20 is closer to a back surface 26 of the first building panel 20 than the point 70 of the upper surface 57 of the locking strip 53 that is closest to the back surface 26. One advantage with this is that the thickness of the locking strip of the second mechanical locking device is independent of the length of the protruding first portion 41 of the connecting portion 5. This allows for using the same coupling element with building panels of different thickness, which reduces the need to produce different coupling elements for every thickness of building panels. The coupling element is thus more versatile. The upper surface 57 of the locking strip 53 may be planar, except for the locking element 54 which may protrude from the locking strip 53, preferably towards the plane V2 of the front surface 25 of the first building element. Thus, when the upper surface 57 of the locking strip is planar, the point 70 may be in the plane of the upper surface 57.

The protruding member 7 may be configured to bridge a play P between a primary plane V1 of a front surface of the coupling element 2 and a back surface 26 of the first panel 20.

The second mechanical locking device 50 may further comprise a locking groove 55 and the locking strip 53 may comprise a locking element 54. The locking groove 55 may be configured to cooperate with the locking element 54 for a locking in a direction of the secondary axis Z1. In particular, the locking element 54 may cooperate with a locking surface 56 in the locking groove 55. The locking surface 56 may prevent the locking tongue 51 from displacement in the directions along a secondary axis Z1, typically vertically. The locking surface 56 may by located in a recess 55*b* in the locking groove 55.

Figure 5A:
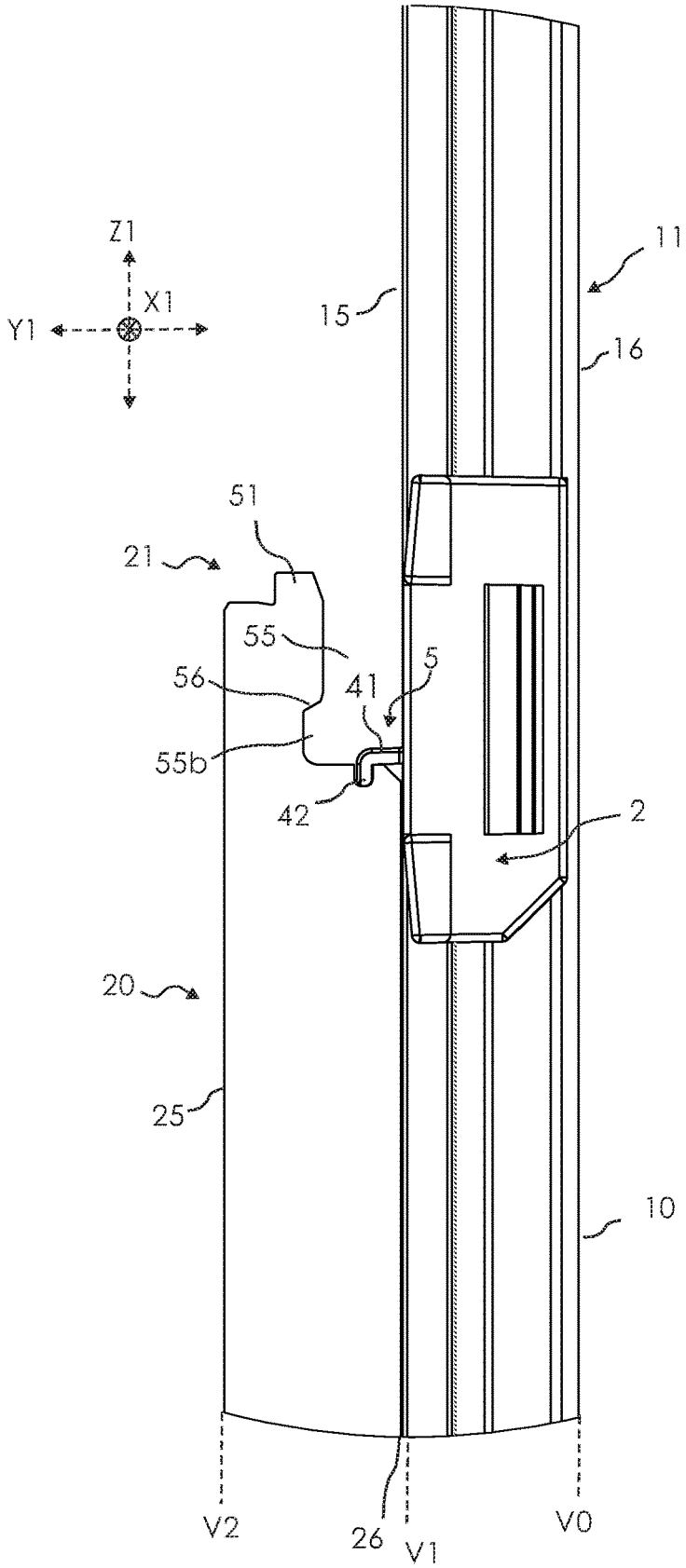
FIG. 5A is a side view of a first building panel arranged in assembled state with a first building element by means of a coupling element, according to one embodiment.
Figure 5B:
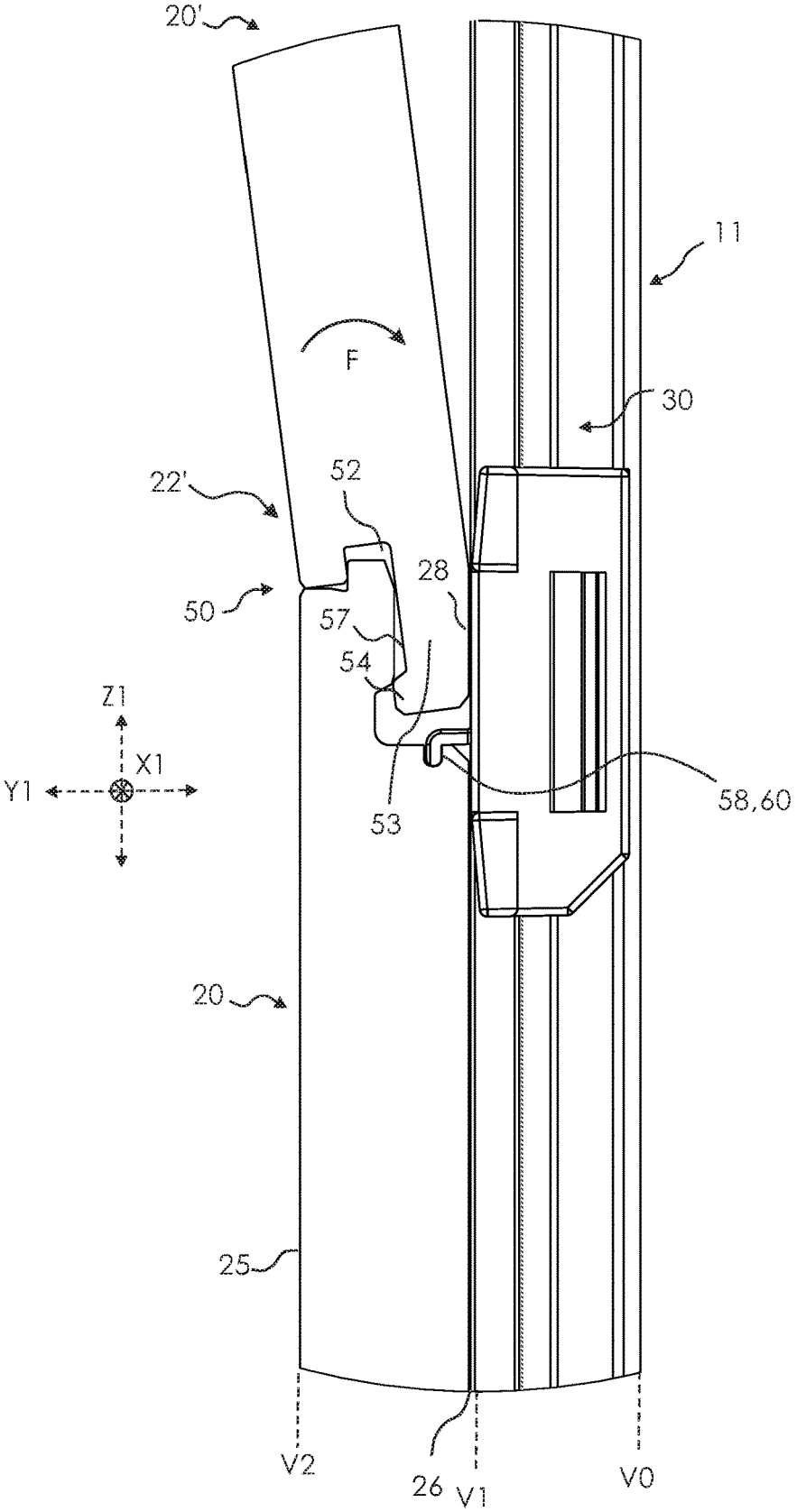
FIG. 5B is a side view of the embodiment of FIG. 5A with a second panel being assembled to the first panel by means of a folding displacement.

The connecting surface 58 may be part of a recess, a shelf 59 (see FIG. 4B) or a groove 60 (see FIG. 5B).

FIGS. 5A and 5B show a side view of one embodiment. As is shown, the second mechanical locking device 50 may be reversed compared to that of the embodiment shown in FIGS. 4A and B. The locking tongue 51 may be located on the first edge 21 of the first building panel 20 and the tongue groove 52 on the second edge 22' of the second building panel 20'. The locking strip 53 of the tongue groove may thus be on the second edge 22' of the second building panel 20'. Accordingly, the upper surface 57 of the locking strip 53 may also be on the second edge 22' of the second building panel 20'. The second mechanical locking device 50 is configured for locking the first and second panels 20, 20' in a direction of the tertiary axis Y1 which is transverse a plane of a front surface 25, 25' of the first and the second building panels 20, 20' by means of a folding displacement of the second panel about its second edge 22'. The second mechanical locking device 50 comprises a locking tongue 51 and a tongue groove 52, said tongue groove having a locking strip 53 with an upper surface 57. In order for the locking groove 55 to receive the locking strip 53, including the locking element 54, there may be a bevel 28 in the back surface 26 at the second edge 22' of the second building panel. The bevel 28 may extend from the second edge 22', preferably the bevel 28 does not extend longer than the locking strip 53. For example, the bevel 28 may extend 5 to 100% of the length of the locking strip 53, such as 20-80%, such as 30 to 70%. Moreover, relative to the back surface 26, the bevel surface may be at an angle of 3-45°, such as 4-25°, such as 5-15°. The connecting portion 5 comprises a first portion 41 protruding along the tertiary axis Y1 and a contiguous second portion 42 protruding along the primary axis Z1 in assembled state. The second portion 42 is configured to engage with a connecting surface 58 of said first building panel 20. The connecting surface 58 of said first building panel 20 is closer to a back surface 26 of the first building panel 20 than the upper surface of the locking strip that is closest to the back surface 26', such as the point 70 of the upper surface 57 of the locking strip 53 that is closest to the back surface 26'. The connecting surface 55 may be a groove 57.

As an alternative to the bevel 28 in the back surface 26' at the second edge 22' of the second building panel, the locking strip may be flexible.

Figure 6A:
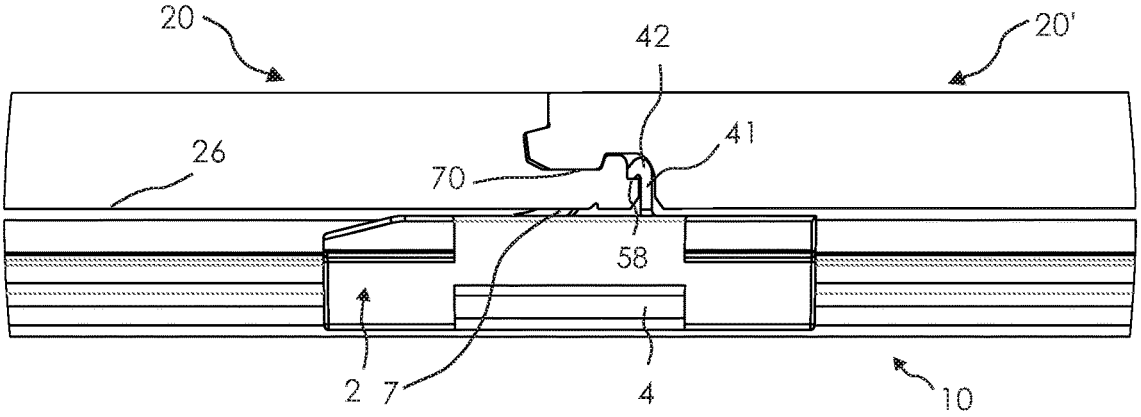
FIG. 6A shows a coupling element in assembled state with a building element, a first panel and a second panel according to one embodiment.
Figure 6B:
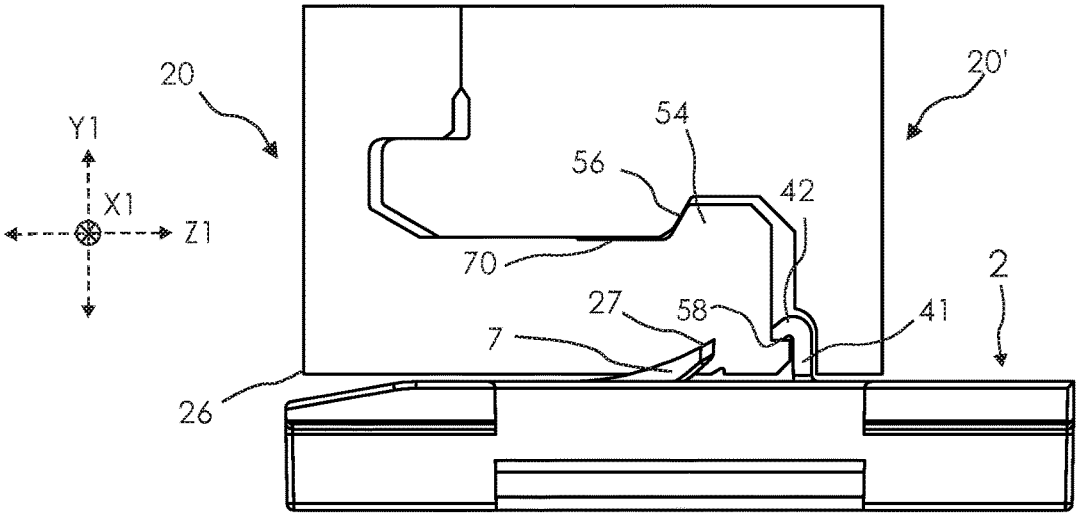
FIG. 6B shows a coupling element in assembled state with a first panel and a second panel according to one embodiment. Building element not shown for clarity purposes.
Figure 6C:
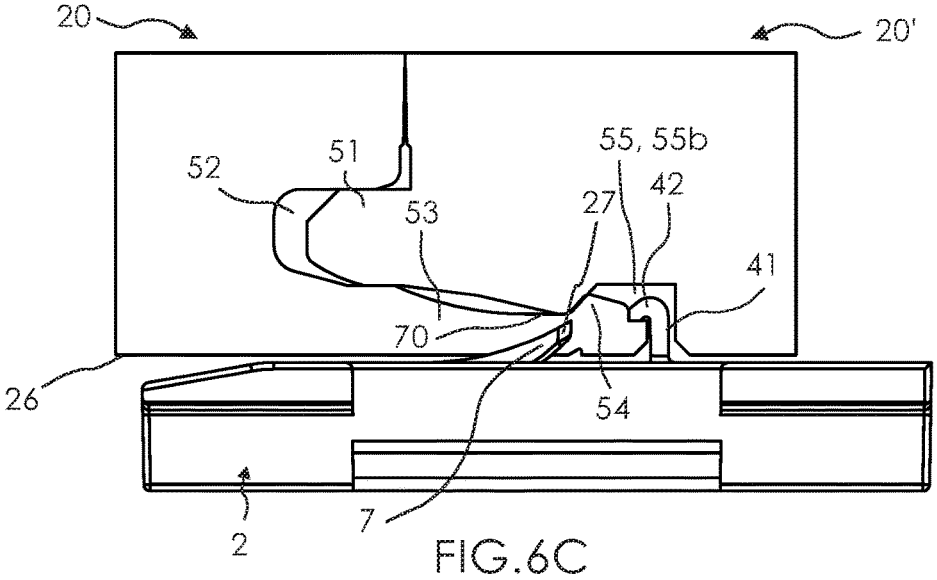
FIG. 6C shows a coupling element in assembled state with a first panel and a second panel according to one embodiment. Building element not shown for clarity purposes.

FIGS. 6A-6C show three different embodiments according to the disclosure. The ratio between the thickness of the building panels and the thickness of the coupling element 2 may be different. The second mechanical locking device 50 comprises a locking tongue 51 and a tongue groove 52, said tongue groove having a locking strip 53 with an upper surface 57. The connecting portion 5 comprises a first portion 41 protruding along the tertiary axis Y1 and a contiguous second portion 42 protruding along the secondary axis Z1 in assembled state. The second portion 42 is configured to engage with a connecting surface 58 of said first building panel 20. The connecting surface 58 of said first building panel 20 is closer to a back surface 26 of the first building panel 20 than the upper surface 57 of the locking strip 53 that is closest to the back surface 26, such as the point 70 of the upper surface of the locking strip 53 that is closest to the back surface 26. The connecting surface 58 may be a shelf 59. The coupling element 2 may further comprise a protruding member 7 configured to cooperate with the first panel 20. The protruding member 7 may be configured to, in assembled state of the coupling element 2 with the first panel 20, cooperate with a groove 27 (see FIGS. 6B & 6C) provided in the back surface 26 of the first panel 20 to thereby lock or prevent the connecting portion 5 and the first edge 21 of the first panel 20 from parting away from each other in a direction along the secondary axis Z1. At least a part of said protruding member 7 may be elastic. The protruding member 7 may extend 3 to 15 mm, such as 3 to 10 mm, such as 4 to 6 mm in a direction along the secondary axis Z1. The protruding member 7 may comprise at least one portion 7*b* that is displaceable relative to the secondary connecting means 5, such as in a direction along the tertiary axis Y1. The force required to displace the at least one portion 7*b* may be 1 to 100 N, such as 5 to 50 N, such as 20 to 30 N along the normal of the front surface of the coupling element.

The protruding member 7 may be configured to, in the assembled state of the coupling element 2 and the first building element 10, protrude from a primary plane V1 of a front surface of the coupling element 2. The protruding member 7 may be configured to, in the assembled state of the coupling element 2 with the first panel 20, bias against the back surface 26 of the first building panel 20 (see e.g., FIG. 6A). The protruding member 7 may be configured to, in the assembled state of the coupling element 2 with the first panel 20, also be biased when cooperating with the groove 27 in the back surface 26 of the first building panel 20.

Figure 7A:
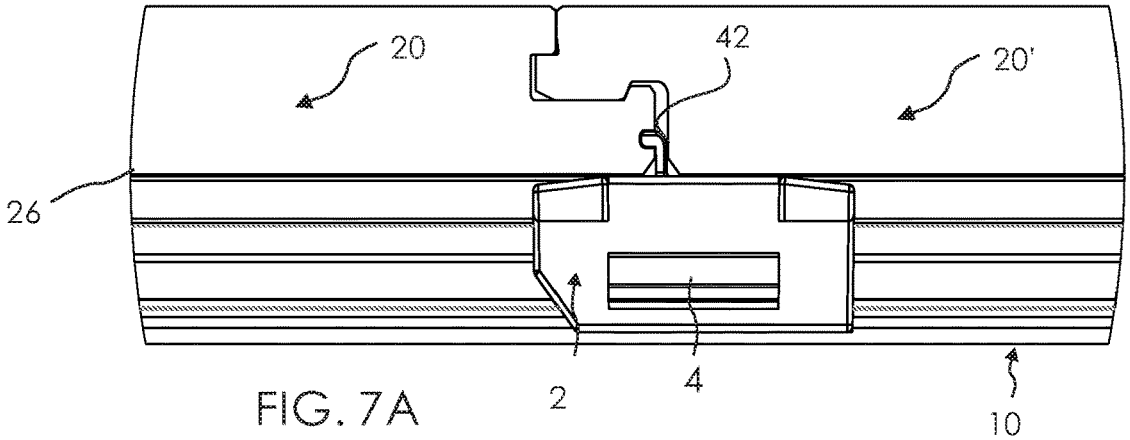
FIG. 7A shows a coupling element in assembled state with a building element, a first panel and a second panel according to one embodiment.
Figure 7B:
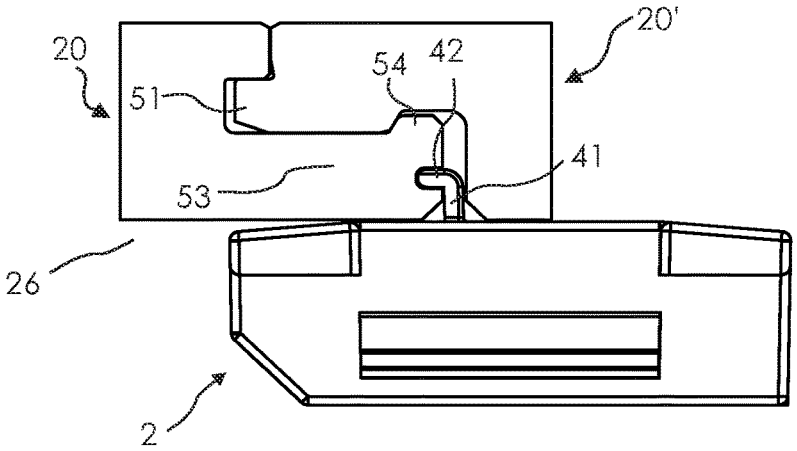
FIG. 7B shows a coupling element in assembled state with a first panel and a second panel according to one embodiment. Building element not shown for clarity purposes.
Figure 7C:
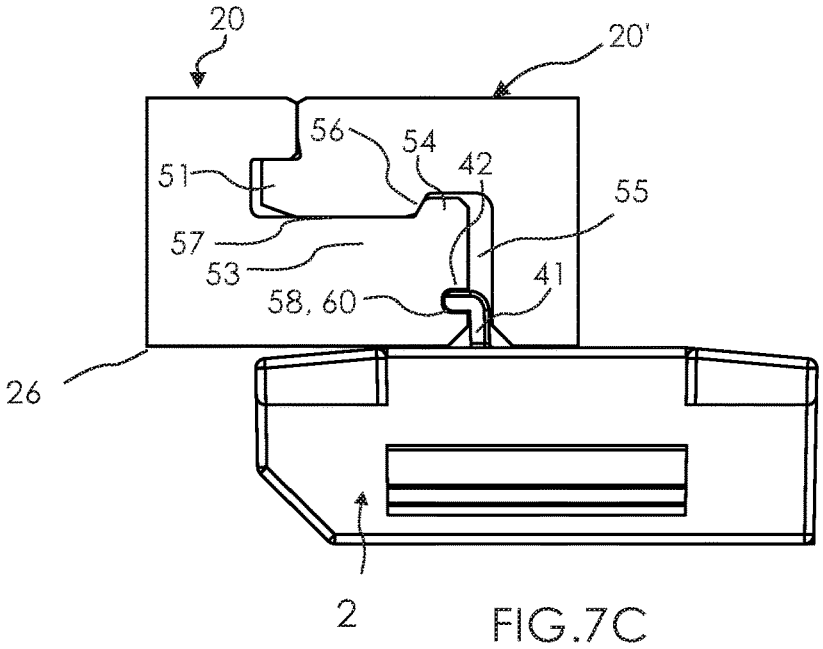
FIG. 7C shows a coupling element in assembled state with a first panel and a second panel according to one embodiment. Building element not shown for clarity purposes.
Figure 8A:
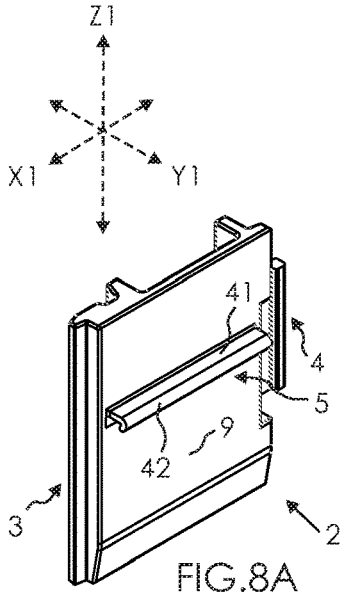
FIGS. 8A-8I show isometric views of a coupling element according to one embodiment.
Figure 8C:
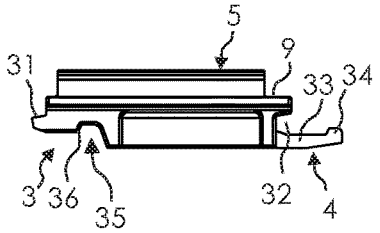
Figure 8B:
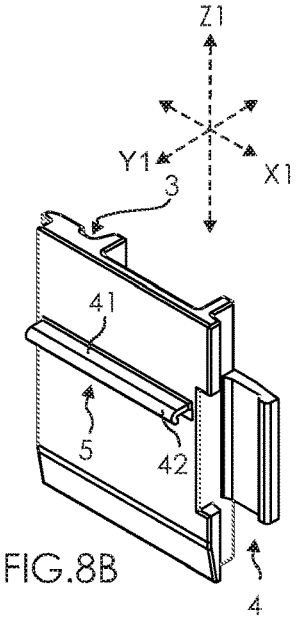
Figure 8D:
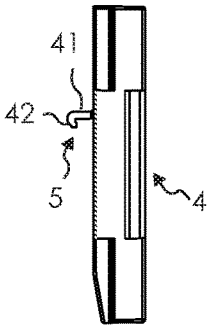
Figure 8E:
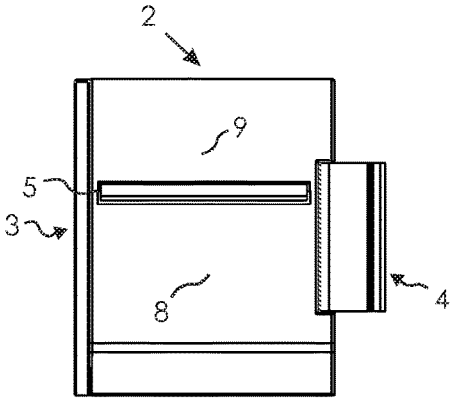
Figure 8F:
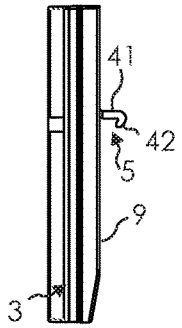
Figure 8G:
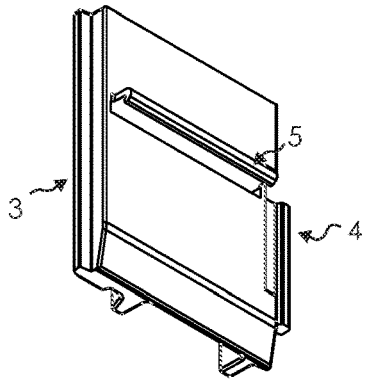
Figure 8I:
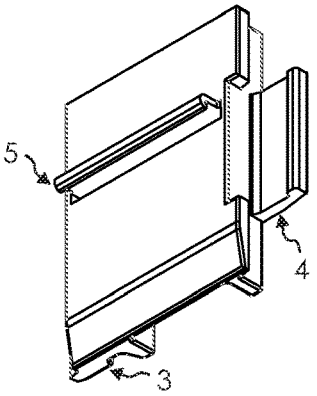
Figure 8H:
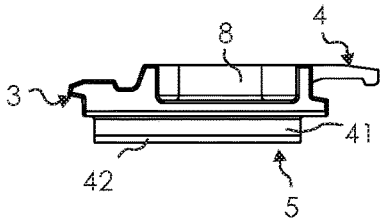
Figure 9A:
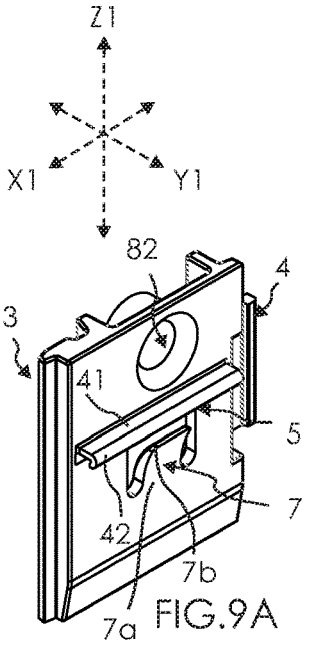
FIGS. 9A-9I show isometric views of a coupling element according to one embodiment.
Figure 9C:
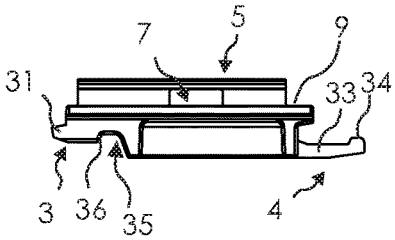
Figure 9B:
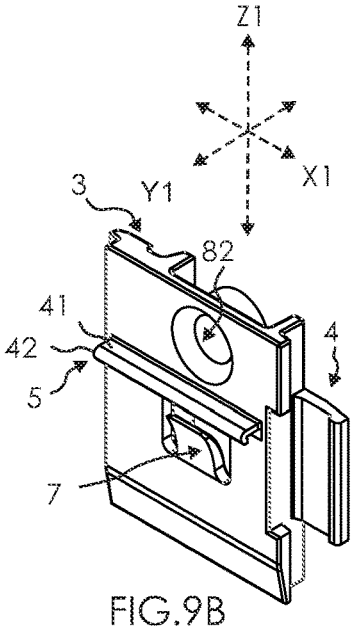
Figure 9D:
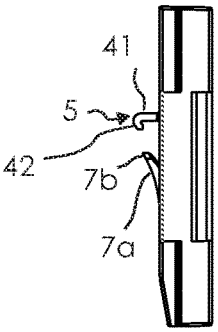
Figure 9E:
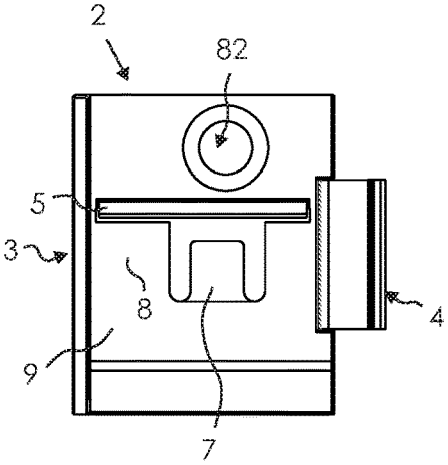
Figure 9F:
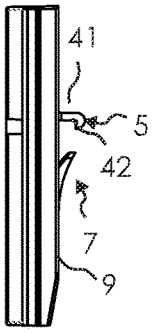
Figure 9G:
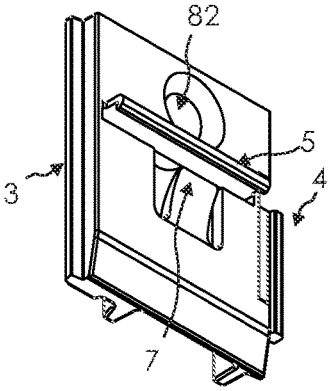
Figure 9H:
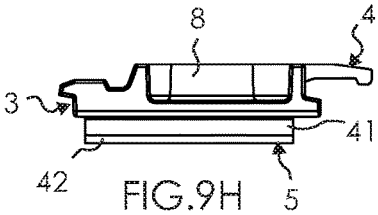
Figure 9I:
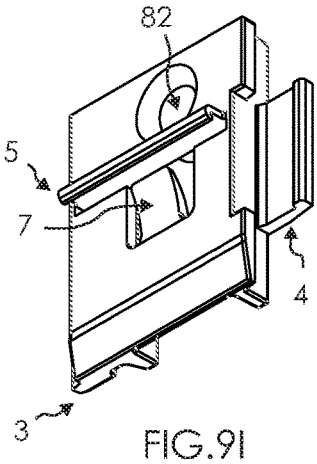

FIGS. 7A-C show three embodiments according to the disclosure, similar to the embodiments in the description of FIGS. 6A-6C but showing that the connecting surface 58 may be part of a groove 57 instead of a shelf. Thus, the locking groove 55 may comprise a groove 60 which comprises the connecting surface 58. The connecting portion 5 comprises a first portion 41 protruding along the tertiary axis Y1 and a contiguous second portion 42 protruding along the secondary axis Z1 in the assembled state. The first portion 41 may protrude into the locking groove 55 in the assembled state. The second portion 42 is configured to engage with the connecting surface 58 of the first building panel 20. The second portion 42 of the connecting portion 5 may thus be in contact with the connecting surface 58.

In FIGS. 7A-7C, no protruding member 7 is shown, but may be either present or absent.

FIGS. 8A-8I show a coupling element 2 according to one embodiment. The coupling element 2 may comprise two locking portions 3, 4 protruding in opposite directions along a primary axis X1. The locking portions 3, 4 may be configured to cooperate with one first mechanical locking device 30. The locking portions 3, 4 may be different from each other. For example, the locking portions may be completing to each other, such as a locking tongue 31 and a tongue groove 32. The locking portion 3 may be configured to cooperate with a first edge 11 of a first building element 10, whereas the locking portion 4 may be configured to cooperate with a second edge 12 of the first building element 10. The first and the second edge 11,12 of a building element may be the two long sides of a building panel. The edges may extend along the secondary axis Z1. The coupling element 2 further comprises a connecting portion 5 protruding in a direction along the tertiary axis Y1. The connecting portion 5 may extend along the primary axis X1 and may be configured to cooperate with a second mechanical locking device 50 of a first edge 21 of a first building panel 20 and an opposite second edge 22 of the second building panel 20'. The connecting portion 5 comprises a first portion 41 protruding along the tertiary axis Y1 and a contiguous second portion 42 protruding along the secondary axis Z1 in assembled state. The second portion 42 is configured to engage with the connecting surface 58 of the first building panel (shown in FIGS. 4A-7C). The connecting surface 58 of the first building panel 20 is closer to a back surface 26 of the first building panel 20 than the point 70 of the upper surface 57 of the locking strip that is closest to the back surface 26. Thus, the first portion 41 may be shorter than the shortest distance from the upper surface 57 of the locking strip 53 to the back surface 26.

FIGS. 9A-9I show a coupling element 2 according to one embodiment, having the same features as those described above for FIGS. 8A-81. In addition, the coupling element 2 may comprise a protruding member 7 configured to cooperate with the first building panel such as the back surface 26 of the first building panel. The protruding member 7 may comprise at least one portion 7*b* that is displaceable relative the connecting portion 5, such as in a direction along the tertiary axis Y1. Further, the coupling element may comprise a fastening hole 82 for a screw or the like, to be able to even more securely fasten the coupling element 2 to a fixed structure, such as a wall 80, behind the assembled building elements 20, 20'. The protruding member 7 may comprise an attached portion 7*a* and a free portion 7*b*, preferably said free portion 7*b* is an end portion. The protruding member 7 may comprise a portion protruding along the secondary axis Z1 in a direction towards or away from the connecting portion 5, and from an attached portion 7*a* to a free portion 7*b*. A portion of said protruding member 7, preferably the free portion 7*b*, may comprise means configured to facilitate friction, such as friction between the free portion 7*b* and an adjacent surface, such as the back surface 26 of the first panel 20. Said means may comprise a pattern and/or a material configured to facilitate friction. Said material may be a material different from the material of the coupling element body 8. Thus, the protruding member 7 may in any embodiment comprise a different material. The means for facilitating friction may comprise a polymer-based material such as rubber or a silicone. The fastening hole 82 and the protruding member 7 are optional features as illustrated in FIGS. 8A-81 and 9A-91. The fastening hole 82 and the protruding member 7 are independent features and may by alone or combined.

Figure 10:
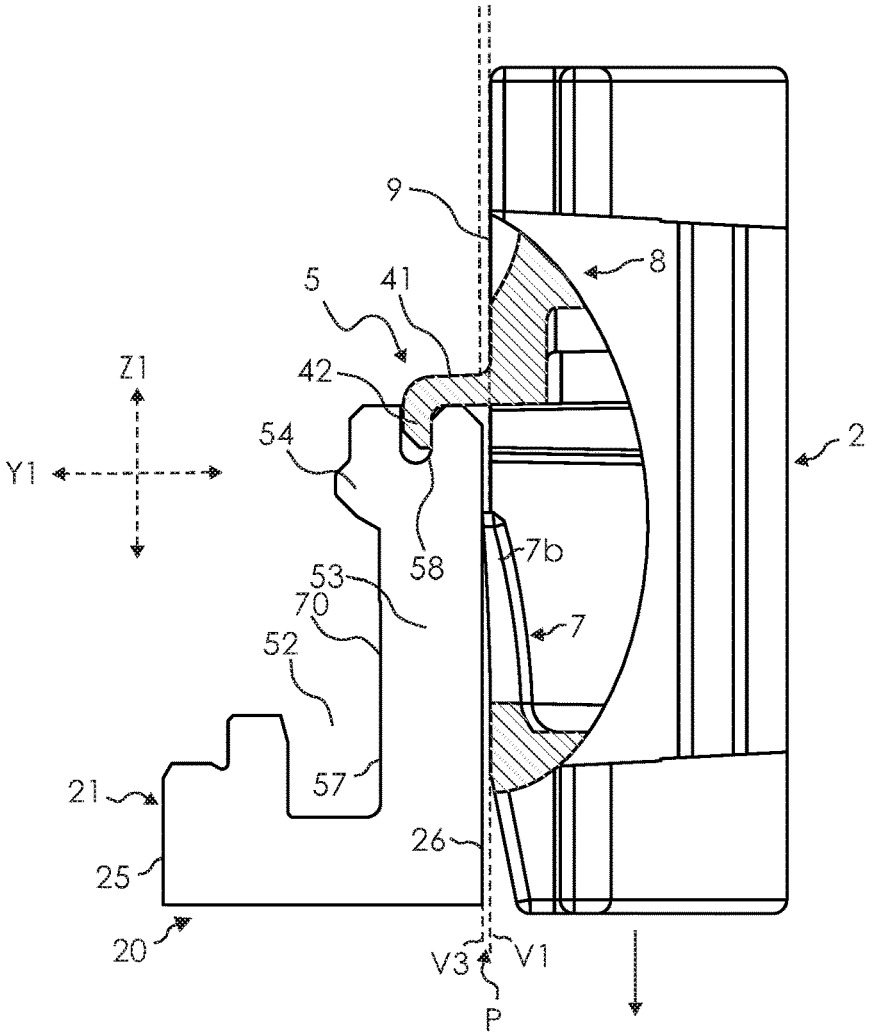
FIG. 10 shows a cross section of a coupling element in assembled state with a first panel according to an embodiment.

Referring to FIG. 10, according to one embodiment the protruding member 7 is configured to cooperate with a back surface 26 of the first building panel 20. The protruding member 7 may be configured for relative positioning of at least a portion of the coupling element 2, such as the connecting portion 5, and at least a portion of the first panel 20, such as the first edge 21. The protruding member 7 may be configured to, in assembled state of the coupling element 2 with the first panel 20, bias against the back surface 26 of the first building panel 20. The protruding member 7 may be elastic. The protruding member 7 may further be configured to, in assembled state of the coupling element 2 with the first panel 20, bias the connecting portion 5 in a direction along the tertiary axis Y1 towards the first building panel 20, such as in a distal direction. The protruding member 7 may be configured to bridge a play P between a primary plane V1 of a front surface of the coupling element 2 and a back surface 26 of the first panel 20.

Figure 11:
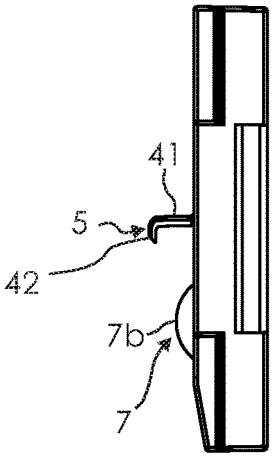
FIG. 11 show a side view of a coupling element according to one embodiment.
Figure 12A:
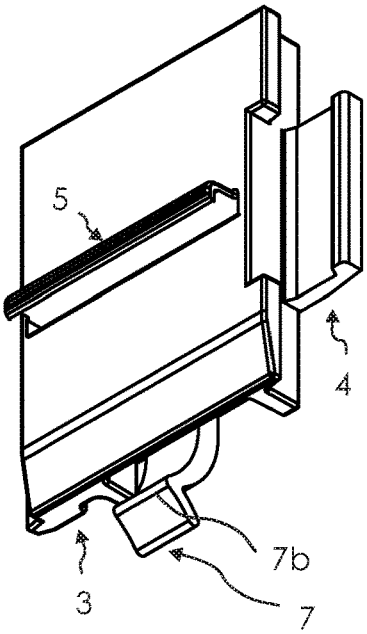
FIGS. 12A-12D show an isometric view of different embodiments of a coupling element.
Figure 12B:
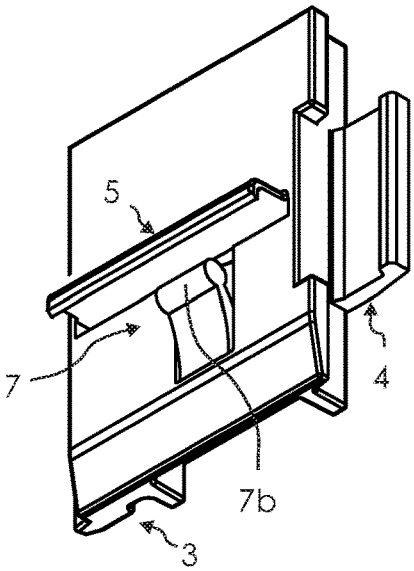
Figure 12C:
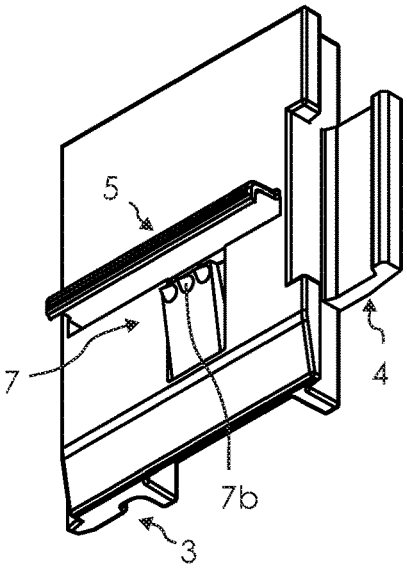
Figure 12D:
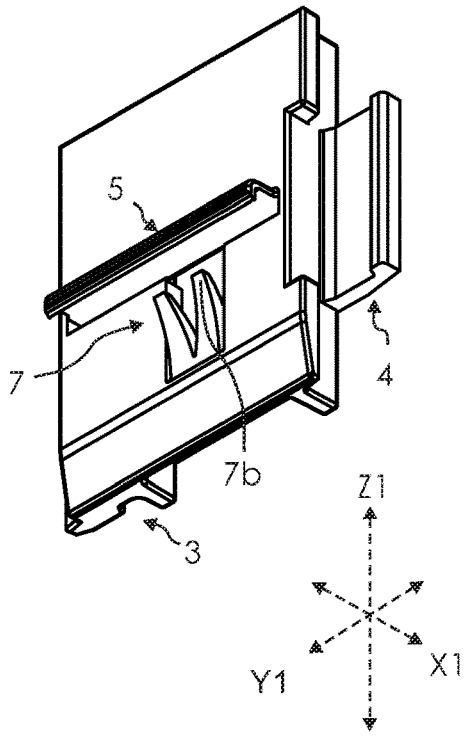

Referring to FIGS. 11, the protruding member 7 may comprise at least one portion 7*b* that is displaceable relative the secondary connecting portion 5, such as in a direction along the tertiary axis Y1. A portion of said protruding member 7, may comprise means configured to facilitate friction, such as friction between the free portion 7*b* and an adjacent surface, such as the back surface 26 of the first panel 20. Said means may comprise a pattern and/or a material configured to facilitate friction. Said material may be a material different from the material of the coupling element body 8. Thus, the protruding member 7 may in any embodiment comprise a different material. The means for facilitating friction may comprise a polymer-based material such as rubber or a silicone.

Referring to FIGS. 12A-12D, the protruding member 7 may comprise at least one portion 7*b* that is displaceable relative the secondary connecting portion 5, such as in a direction along the tertiary axis Y1. The protruding member 7 may comprise an attached portion 7*a* and a free portion 7*b*, preferably said free portion 7*b* is an end portion. The protruding member 7 may comprise a portion protruding along the secondary axis Z1 in a direction towards or away from the connecting portion 5, and from an attached portion 7*a* to a free portion 7*b*. A portion of said protruding member 7, preferably the free portion 7*b*, may comprise means configured to facilitate friction, such as friction between the free portion 7*b* and an adjacent surface, such as the back surface 26 of the first panel 20. Said means may comprise a pattern, such as a nib, a point or a spike, and/or a material configured to facilitate friction. Said material may be a material different from the material of the coupling element body 8. Thus, the protruding member 7 may in any embodiment comprise a different material. The means for facilitating friction may comprise a polymer-based material such as rubber or a silicone. The protruding member 7 may extend 3 to 15 mm, such as 3 to 10 mm, such as 4 to 6 mm in a direction along the secondary axis Z1. The protruding member 7 may comprise at least one portion 7*b* that is displaceable relative to the secondary connecting means 5, such as in a direction along the tertiary axis Y1. The displacement of the at least one portion 7*b* may be 1-10 mm, such as 1-5 mm relative to the secondary connecting means 5, such as in a direction along the tertiary axis Y1. The force required to displace the at least one portion 7*b* may be 1 to 100 N, such as 5 to 50 N, such as 20 to 30 N along the normal of the front surface of the coupling element. The protruding member may be squared. The free portion 7*b* may be for example straight, split in two, cylindrical or pointed.

The invention claimed is:

1. A set comprising a coupling element, a first building element, a first building panel and a second building panel, wherein the coupling element is configured for assembling the first building panel and the second building panel to the first building element, wherein the coupling element comprises at least one locking portion protruding along a primary axis, wherein the locking portion is configured to cooperate with a first mechanical locking device of a first edge or of a second edge of the first building element, each extending along a secondary axis, to obtain an assembled state therewith by means of a folding displacement of the coupling element about the secondary axis to thereby lock the coupling element from displacement along a primary axis and a perpendicular tertiary axis each being orthogonal to the secondary axis;

wherein the coupling element comprises a connecting portion protruding in a direction along the tertiary axis and is configured to cooperate with a second mechanical locking device of a first edge of a first building panel or an opposite second edge of the second building panel, wherein the second mechanical locking device is configured for locking the first and second building panels in a direction of the tertiary axis, the tertiary axis being transverse a plane of a front surface of the first and the second building panels by means of a folding displacement of the second building panel about the second edge of the second building panel, wherein the second mechanical locking device comprises a locking tongue and a tongue groove, said tongue groove having a locking strip with an upper surface, wherein the connecting portion comprises a first portion protruding along the tertiary axis and a contiguous second portion protruding along the secondary axis in the assembled state, said second portion configured to engage with a connecting surface of said first building panel, wherein the connecting surface of said first building panel is closer to a back surface of said first building panel than a point of the upper surface of the locking strip that is closest to the back surface.

2. The set according to claim 1, wherein the second mechanical locking device comprises a locking groove and the locking strip comprises a locking element, wherein the locking groove is configured to cooperate with the locking element for a locking in a direction of the secondary axis.

3. The set according to claim 2, wherein the locking strip comprises the connecting surface or the locking groove comprises the connecting surface.

4. The set according to claim 1, wherein the connecting surface is part of a shelf or a groove.

5. The set according to claim 1, wherein the locking strip comprises a shelf, the shelf comprising the connecting surface.

6. The set according to claim 1, wherein the locking groove comprises a groove, the groove comprising the connecting surface.

7. The set according to claim 1, wherein the first portion protrudes into the locking groove in the assembled state.

8. The set according to claim 1, wherein the coupling element further comprises a protruding member configured to cooperate with the first building panel.

9. The set according to claim 8, wherein at least a part of said protruding member is elastic.

10. The set according to claim 8, wherein said protruding member is configured to, in the assembled state of the coupling element and the first building element, protrude from a primary plane of a front surface of the coupling element.

11. The set according to claim 8, wherein said protruding member is configured to cooperate with a back surface of the first building panel.

12. The set according to claim 8, wherein said protruding member is configured for relative positioning of at least a portion of the coupling element, and at least a portion of the first building panel.

13. The set according to claim 8, wherein said protruding member is configured to, in the assembled state of the coupling element with the first building panel, bias against the back surface of the first building panel.

14. The set according to claim 8, wherein said protruding member is configured to, in the assembled state of the coupling element with the first building panel, bias the connecting portion in a direction along the tertiary axis towards the first building panel.

15. The set according to claim 8, wherein the protruding member is configured to bridge a play between a primary plane of a front surface of the coupling element and a back surface of the first building panel.

16. The set according to claim 8, wherein said protruding member is configured to, in the assembled state of the coupling element with the first building panel, cooperate with a groove provided in the back surface of the first building panel to thereby lock or prevent the connecting portion and the first edge of the first building panel from parting away from each other in a direction along the secondary axis.

17. The set according to claim 8, wherein said protruding member comprises a free portion that is displaceable relative the connecting portion.

18. The set according to claim 8, wherein said protruding member comprises an attached portion and a free portion.

19. The set according to claim 8, wherein said protruding member comprises a portion protruding along the secondary axis in a direction towards or away from the connecting portion, and from an attached portion to a free portion.

20. The set according to claim 8, wherein at least one portion of said protruding member comprises means configured to facilitate friction.

* * * * *